US005329569A

United States Patent [19]

Spielman

[11] Patent Number: 5,329,569

[45] Date of Patent: Jul. 12, 1994

[54] X-RAY TRANSMISSIVE DEBRIS SHIELD

[75] Inventor: Rick B. Spielman, Albuquerque, N. Mex.

[73] Assignee: Sandia Corporation, Albuquerque, N. Mex.

[21] Appl. No.: 19,010

[22] Filed: Feb. 18, 1993

[51] Int. Cl.[5] ..... G21K 1/00

[52] U.S. Cl. ..... 378/161; 378/140; 378/145

[58] Field of Search ..... 378/140, 161, 145

[56] References Cited

U.S. PATENT DOCUMENTS 4,178,509 12/1979 More et al. ..... 378/161 X
4,408,338 10/1983 Grobman ..... 378/34
4,692,934 9/1987 Forsyth ..... 378/34
4,837,794 6/1989 Riordan et al. ..... 378/119
4,933,557 6/1990 Perkins et al. ..... 250/505.1
4,960,486 10/1990 Perkins et al. ..... 156/633
4,980,896 12/1990 Forsyth et al. ..... 372/101
5,090,046 2/1992 Friel ..... 378/161

*Primary Examiner*—David P. Porta
*Attorney, Agent, or Firm*—Timothy D. Stanley

[57] ABSTRACT

A composite window structure is described for transmitting x-ray radiation and for shielding radiation generated debris. In particular, separate layers of different x-ray transmissive materials are laminated together to form a high strength, x-ray transmissive debris shield which is particularly suited for use in high energy fluences. In one embodiment, the composite window comprises alternating layers of beryllium and a thermoset polymer.

20 Claims, 3 Drawing Sheets

X-RAY TRANSMISSIVE DEBRIS SHIELD

BACKGROUND OF THE INVENTION

The present invention relates generally to a window structure for transmitting x-ray radiation and for shielding undesirable debris resulting from the x-ray radiation generation process.

A variety of window systems have been developed for irradiating samples. By way of example, Forsyth et al. in U.S. Pat. Nos. 4,980,896 and 4,697,934; Riordan et al. in U.S. Pat. No. 4,837,794 and Grobman in U.S. Pat. No. 4,408,338 each describe a method of x-ray lithography of semiconductor chips. In fact, the use of x-ray lithography is often times preferred because of its ability to produce line widths less than one micron. Soft x-rays (i.e. relatively long wavelengths and low penetrating power) are particularly useful for such applications. Soft x-rays can be generated by a variety of known techniques; however, such x-ray generation processes can also produce unwanted debris which can adversely interfere with the x-ray lithography process. In one x-ray lithography system, a pulsed plasma source is used for x-ray generation. Such sources convert an electrical input into x-rays using the phenomena of gas jet z-pinch. In this method of x-ray generation, a burst of a gas (e.g. nitrogen, krypton, or argon) is expanded using a nozzle in concert with the fast discharge of a capacitor bank through the expanding gas. A high current discharge and the resulting intense magnetic field radically compresses the plasma. The result is a dense, high temperature plasma which is a very intense source of desirable x-rays with comparatively long wavelengths and hence, low penetrating power (i.e. soft x-rays). Unfortunately, generated along with the x-rays are hot gases, charged particles and other debris having instantaneous accelerations exceeding 100 g's.

Consequently, a need exists for a window structure which allows transmission of the x-rays, yet blocks or shields the sample from undesirable radiation generated debris. For electromagnetic radiation above about 1000 Å in wavelength, or below about 1 Å in wavelength, practical transmissive debris shield materials exist, (e.g. quartz and beryllium). However, for electromagnetic radiation between about 1000 and 1 Å in wavelength, no single practical window material exists. Known durable window materials are not sufficiently transparent to electromagnetic radiation within this range while window materials which are sufficiently transparent within of this range are not very durable. Unfortunately, this is precisely the range in which high resolution microcircuit lithography is contemplated. Satisfying these dual, competing requirements has been greatly impeded because no one material or structure has been discovered which exhibits both the required transmissivity for x-rays and the structural strength to withstand the impact of debris. As such typical x-ray lithography systems employ a first structure as a window and a second, spaced apart structure as a debris shield. See e.g. Riordan et al., Grobman. More recently, Perkins et al. in U.S. Pat. Nos. 4,960,486 and 4,933,557 have proposed a structure composed of an x-ray transmissive film material overlaid onto a structural support.

In spite of such advances, a need still exists for a single window structure combining both transmissive and debris shielding capabilities. The present invention provides a novel x-ray transmissive shield composed of materials having complementary properties so as to overcome the limitations of existing window and debris shield systems.

SUMMARY OF THE INVENTION

The present invention relates generally to a window structure for transmitting radiation and for shielding undesirable radiation generated debris. More specifically, a composite window comprising thin film layers of first and second materials laminated together is described. By selecting materials having complementary properties, a novel x-ray window is produced having superior structural strength and high radiation fluence capabilities compared to those either material by itself. Preferably, materials are selected from a first group having high tensile strength and low melting points and from a second group having low tensile strength and high melting points. In one embodiment, a layer of a highly x-ray transmissive material is laminated to a layer of an x-ray transmissive polymeric material. In an alternative embodiment, a layer of highly x-ray transmissive material is laminated to both faces of each layer of polymeric material.

DESCRIPTION OF THE DRAWINGS

The present invention will be best understood by reference to the drawings included herewith and the detailed description provided below.

DETAILED DESCRIPTION OF THE INVENTION

Figure 1:
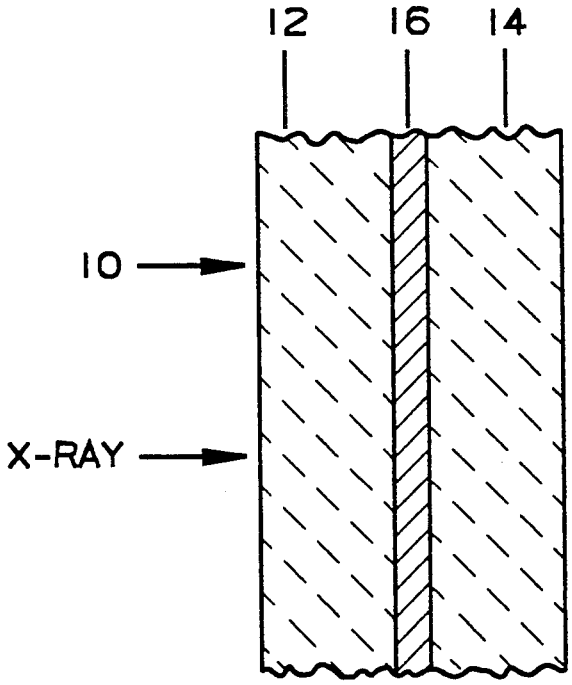
FIG. 1 depicts a first x-ray transmissive shield according to the present invention.

In order to better understand the present invention, the following introductory discussion is provided. Application of x-rays to real processes requires containment of undesirable debris resulting from the x-ray generation process. This is especially important in x-ray lithographic processes wherein cleanliness of the irradiated sample is of the utmost importance. Typical x-ray generation systems include a window which is highly transmissive for x-ray radiation. Unfortunately, materials which have the required transmissivity (i.e. low opacity) to act as a window for x-rays often times do not have the required structural or tensile strength to act as barrier or shield to the undesirable debris. In fact, for soft x-rays (i.e. wavelengths of about 1–1000 Angstroms) no one single material has been found which exhibits all of the required properties to act as both a window and a debris shield or barrier. Presently, two approaches have been developed for resolving such dilemma: first, simply select materials which satisfy the transmissivity requirement and replace windows as they fail or second, develop systems comprising spaced apart debris shields and x-ray windows and replace the lower cost debris shields as they fail. However, neither solution has provided a cost effective solution to designing x-ray transmissive debris shields.

The present invention provides a novel x-ray transmissive shield superior to existing window and debris shield systems. As will be described in more detail below, the x-ray transmissive shield of the present invention comprises a layer of a first x-ray transmissive material laminated to a layer of a second x-ray transmissive material. The resulting composite window structure has sufficient structural strength to be free standing and to withstand the impact of radiation generated debris as well as the required x-ray transmissivity. The individual properties of each material are complementary so as to synergestically yield an x-ray transmissive debris shield having superior operating characteristics to those of x-ray transmissive debris shields composed of one or the other of such materials.

Looking now to FIG. 1, the present invention will be described in more detail. An x-ray transmissive shield 10 comprises a layer 12 of a first x-ray transmissive material and a layer 14 of a second x-ray transmissive material. Layer 12 is laminated to layer 14 with adhesive 16. Those skilled in the art will appreciate that other methods for laminating or bonding the layers together can be used. An important element of the present invention resides in the selection of such materials (12, 14) and adhesive 16. Generally, such first and second materials are selected from groups of materials exhibiting either high tensile strength and low melting point, or low tensile strength and high melting point. As used herein, the terms high and low are relative terms comparing a property of a material in one group to the corresponding property of a material in the other group.

Recognizing that no one material has yet been found which can satisfy all the requirements for a transmissive debris shield for soft x-rays, the starting point for designing any x-ray transmissive shield is to first identify its required characteristics. Since typical x-ray generation systems have very low x-ray generation efficiencies, high transmissivity (i.e. low opaqueness) to desired wavelengths of electromagnetic radiation is critical. Transmissivity of a material is related to a product of material thickness and its absorption coefficient. Thus minimizing transmission losses requires minimizing the product of material thickness and absorption coefficient. While selecting a highly x-ray transmissive material (i.e. a low absorption coefficient) would seem to resolve such issue, other factors such as structural or tensile strength and minimum achievable thicknesses of the material greatly impedes the selection process. For example, highly x-ray transmissive materials, such as beryllium (Be), have a very low absorption coefficient and layers as thin as $\sim 12\ \mu m$ can be achieved; however, the usual thicknesses of free standing Be windows are typically much thicker (e.g. $>25\ \mu m$) because Be is an extremely brittle material lacking the required structural strength to withstand the impact of radiation generated debris. A number of ($\sim 50\ \mu m$) thick Be windows were irradiated with 3 KeV x-rays. The fluence of the x-rays was varied from 0.25–1.5 cal/cm$^2$. The area of the Be window was varied from 1 to 5 cm$^2$. After one impulse of the x-ray source, the Be windows exposed fluences $>1.0$ cal/cm$^2$ failed due to mechanical loading. Alternatively, polymeric materials, such as KAPTON, have been employed as x-ray transmissive shields. While such polymeric materials can have usable layer thicknesses less than Be (e.g. KAPTON $\sim 8.5\ \mu m$), such polymeric materials' absorption coefficients are larger than Be resulting in a less transmissive layer. Moreover, such polymeric materials can be adversely affected by high energy radiation fluences because the absorbed radiation results in increased temperatures in the polymeric material which can undergo a substantial degradation in structural strength at elevated temperatures. For example, a ($\simeq 25\ \mu m$) KAPTON window was irradiated with 3 KeV x-rays. The fluence of the x-rays was varied from 0.1 to 1 cal/cm$^2$. The area of the KAPTON window was varied from 1 to 50 cm$^2$. After one impulse of the x-ray source, the KAPTON consistently failed by melting at all area sizes when the fluence was greater than $\sim 0.6$ cal/cm$^2$. Such fluence restriction increasingly limits the x-ray generation systems with which such polymeric materials can be used. In summary, a x-ray transmissive debris shield should have the following characteristics; low absorption coefficient, minimum thickness, good structural strength, high temperature and high energy radiation fluence resistance. Unfortunately, no one material satisfies all such criteria.

Surprisingly, a window or debris shield as depicted in FIG. 1 composed of laminated, alternating thin layers of a highly x-ray transmissive material and a polymeric material has been found to provide superior operating characteristics to those achievable by either material separately. Preferably, the highly x-ray transmissive layer faces the source of x-rays. In particular, highly x-ray transmissive materials having high melting points and high thermal conductivities can be selected from the group including: lithium, boron, beryllium, carbon (diamond), silicon, magnesium, and aluminum as well as alloys thereof. Polymeric materials exhibiting the desired high tensile strengths can be selected from the group including thermoset polymers, MYLAR, KEVLAR, KAPTON, TEFLON, FORMVAR as well as the more general class of polymers including polyvinyl formal, polypropylene, lexan, polyimides, fluorocarbons, fluoropolymers, polycarbonates, polyethylene, polyetherketone, polypropylene, and polystyrene. By laminating thin layers of Be with KAPTON, KAPTON retains its structural strength because Be's high heat conductivity allows it to act as a heatsink to keep the KAPTON cool. In this situation, Be provides no real strength to the composite window and as such, very thin layers of Be can be used; but rather, the composite window relies almost totally on the KAPTON layer for structural integrity.

Depicted in Table I below are the calculated time-temperature responses of a composite window (composed of a layer of Be laminated to a layer of KAPTON) to an instantaneous pulse of x-ray radiation. Temperatures are measured at one location ($B_1$) in the Be and at ten locations ($K_1 \ldots K_{10}$) in the KAPTON, wherein the KAPTON thickness increases according to $K_1$ to $K_{10}$. Under identical x-ray fluences, KAPTON will reach higher peak temperatures at time 0 then Be because of its lower thermal conductivity and higher absorption coefficient. The initial instantaneous temperature for the Be layer is 110° and $\sim$ 700° C. for the KAPTON layer. After as little as 300 $\mu$secs, the KAPTON measuring point furthest removed from the Be layer (i.e. $K_{10}$) has already cooled to below 550° C. Because Be has a high thermal conductivity, it can act as a heatsink and cool the KAPTON layer to a temperature below which it retains its high tensile strength.

TABLE I

| Time | $B_1$ | $K_1$ | $K_2$ | $K_3$ | $K_4$ | $K_5$ | $K_6$ | $K_7$ | $K_8$ | $K_9$ | $K_{10}$ |
|---|---|---|---|---|---|---|---|---|---|---|---|
| 0 | 110 | 701 | 708 | 700 | 696 | 700 | 703 | 700 | 697 | 700 | 703 |
| 1 | 110 | 694 | 700 | 700 | 700 | 700 | 700 | 700 | 700 | 700 | 700 |

TABLE I-continued

| Time | $B_1$ | $K_1$ | $K_2$ | $K_3$ | $K_4$ | $K_5$ | $K_6$ | $K_7$ | $K_8$ | $K_9$ | $K_{10}$ |
|---|---|---|---|---|---|---|---|---|---|---|---|
| 2 | 110 | 659 | 700 | 700 | 700 | 700 | 700 | 700 | 700 | 700 | 700 |
| 3 | 110 | 619 | 698 | 700 | 700 | 700 | 700 | 700 | 700 | 700 | 700 |
| 4 | 110 | 583 | 694 | 700 | 700 | 700 | 700 | 700 | 700 | 700 | 700 |
| 5 | 110 | 552 | 687 | 700 | 700 | 700 | 700 | 700 | 700 | 700 | 700 |
| 6 | 110 | 526 | 679 | 699 | 700 | 700 | 700 | 700 | 700 | 700 | 700 |
| 7 | 110 | 504 | 669 | 698 | 700 | 700 | 700 | 700 | 700 | 700 | 700 |
| 8 | 100 | 485 | 659 | 696 | 700 | 700 | 700 | 700 | 700 | 700 | 700 |
| 9 | 110 | 469 | 649 | 649 | 700 | 700 | 700 | 700 | 700 | 700 | 700 |
| 10 | 110 | 454 | 639 | 691 | 699 | 700 | 700 | 700 | 700 | 700 | 700 |
| 20 | 110 | 366 | 552 | 650 | 687 | 698 | 700 | 700 | 700 | 700 | 700 |
| 30 | 110 | 323 | 495 | 606 | 664 | 689 | 697 | 699 | 700 | 700 | 700 |
| 40 | 110 | 296 | 454 | 569 | 639 | 675 | 391 | 697 | 699 | 700 | 700 |
| 50 | 110 | 277 | 424 | 537 | 614 | 659 | 683 | 694 | 698 | 699 | 700 |
| 60 | 110 | 263 | 401 | 511 | 591 | 643 | 673 | 688 | 695 | 698 | 699 |
| 70 | 110 | 252 | 382 | 489 | 571 | 626 | 661 | 681 | 692 | 696 | 697 |
| 80 | 110 | 243 | 366 | .471 | 552 | 611 | 650 | 674 | 687 | 693 | 695 |
| 90 | 110 | 236 | 353 | 454 | 536 | 596 | 638 | 666 | 681 | 690 | 692 |
| 100 | 110 | 230 | 342 | 440 | 521 | 583 | 627 | 657 | 675 | 685 | 688 |
| 200 | 110 | 195 | 277 | 353 | 422 | 482 | 531 | 569 | 597 | 613 | 618 |
| 300 | 110 | 178 | 244 | 306 | 364 | 414 | 458 | 492 | 517 | 532 | 537 |
| 400 | 110 | 166 | 220 | 272 | 319 | 362 | 398 | 427 | 448 | 461 | 466 |
| 500 | 110 | 156 | 201 | 244 | 284 | 319 | 349 | 373 | 391 | 402 | 405 |
| 600 | 110 | 148 | 186 | 221 | 254 | 283 | 308 | 328 | 343 | 352 | 355 |
| 700 | 110 | 142 | 173 | 202 | 229 | 254 | 274 | 291 | 303 | 311 | 313 |
| 800 | 110 | 136 | 162 | 187 | 209 | 229 | 246 | 260 | 270 | 276 | 279 |
| 900 | 110 | 132 | 153 | 173 | 192 | 209 | 223 | 235 | 243 | 248 | 250 |
| 1000 | 110 | 128 | 146 | 163 | 178 | 192 | 204 | 213 | 220 | 225 | 226 |
| 2000 | 110 | 113 | 116 | 118 | 121 | 123 | 124 | 126 | 127 | 128 | 128 |
| 3000 | 110 | 110 | 111 | 111 | 112 | 112 | 112 | 112 | 113 | 113 | 113 |
| 4000 | 110 | 110 | 110 | 110 | 110 | 110 | 110 | 110 | 110 | 110 | 110 |
| 5000 | 110 | 110 | 110 | 110 | 110 | 110 | 110 | 110 | 110 | 110 | 110 |

Figure 2:
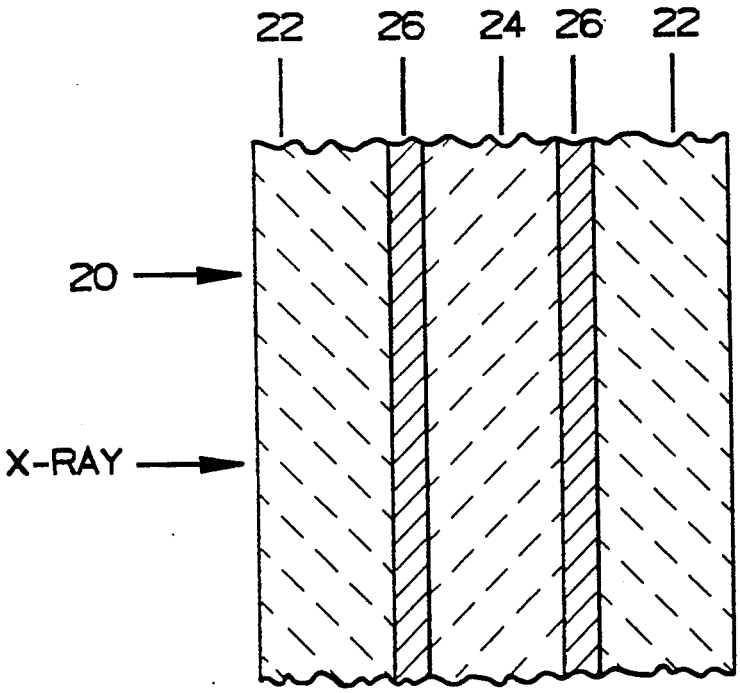
FIG. 2 depicts a second x-ray transmissive shield according to the present invention.
Figure 3:
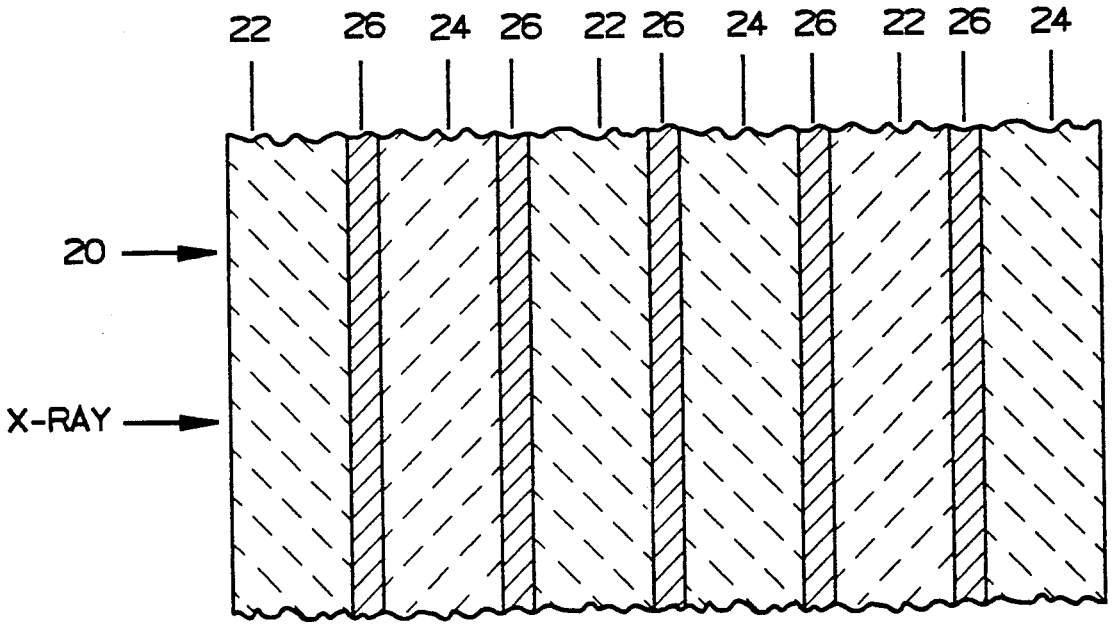
FIG. 3 depicts a window of alternating layers of first and second materials of FIG. 2.

A preferred embodiment of the present invention includes a plurality of alternating layers of a highly x-ray transmissive material laminated to layers of an x-ray transmissive polymeric material. Specifically, FIG. 2 depicts an x-ray transmissive debris shield 20 composed of alternating thin layers of a highly x-ray transmissive material 22 laminated on both faces of a thin layer of a polymeric material 24. Such layers can be laminated one to another with an adhesive 26. Moreover, layers of the highly x-ray transmissive, high heat conductance material as thin as ~12.5 μm and x-ray transmissive polymeric materials as thin as ~2.5 μm are believed to yield satisfactory results. Unfortunately, while a plurality of very thin layers laminated together is preferred, as the number of layers increases as illustrated in FIG. 3 so does the aggregate thickness of the adhesive 26 which is a poor x-ray transmissive material.

EXAMPLE

A 50 μm-thick Be layer was laminated to a 8.5 μm layer of KAPTON as depicted in FIG. 1 using a polyimide enamel varnish. This varnish consisted of the same polymer as KAPTON and was cured at elevated temperatures and pressure. Specifically, a polyimide enamel adhesive was air brushed onto the KAPTON layer and allowed to dry for 15 minutes. The Be layer was then affixed to the adhesive side of the KAPTON layer under 1500 PSI pressure and heated to a temperature of 212° F. and held for one hour, then heated to a temperature of 302° F. and held for one hour, then heated to a temperature of 419° F. and held for one hour and finally cooled to room temperature. In particular, 5-$cm^2$ area, debris fluence on the debris shields was varied from 0.5 to 0.75 cal/$cm^2$. The debris shields survived the test with no visible damage to either the KAPTON or Be layers.

While the present invention has been described with reference to specific materials, those skilled in the art will recognize that variation in the material selection can be made without departing from the scope of the claims appended hereto. Moreover, while the present invention has been shown useful with pulsed x-ray sources, it is also useful with continuous x-ray sources.

I claim:

1. A composite window structure for transmitting x-ray radiation and for shielding radiation generated debris, comprising:

a layer of a first x-ray transmissive material; and a layer of second x-ray transmissive material having a thermal conductivity greater than the first material and being at least ~12 μm in thickness, wherein said layers are laminated face-to-face.

2. The composite window of claim 1, wherein the ratio of tensile strength of said first material to said second material is >1.

3. The composite window of claim 1, wherein the ratio of melting points of said second material to said first material is >1.

4. The composite window of claim 1, further including a plurality of alternating layers of first and second materials.

5. The composite window of claim 1, further including at least three layers, wherein a layer of second material is laminated to opposite sides of the layer of first material.

6. The composite window of claim 1, wherein said first material is a thermoset polymer.

7. The composite window of claim 1, wherein said second material is selected from the group including: beryllium, boron, lithium, carbon (diamond), silicon, magnesium, aluminum, and alloys thereof.

8. The composite window of claim 7, wherein the layer of said first material is at least 2.5 μm thick.

9. The composite window of claim 6 wherein said polymeric material is selected from the group including: polyimides, fluorocarbons, fluoropolymers, polycarbonate, polyethylene, polyetherketone, polypropylene, polycarbonate, polystyrene, poly-vinyl formal, and lexan,

10. A composite window structure for transmitting x-ray radiation and shielding radiation generated debris, comprising:

alternating layers of x-ray transmissive materials laminated together; wherein the materials are selected from a first group of high melting point materials and from a second group of high tensile strength materials and the materials from the first group have a layer thickness of at least ~12 μm sufficient for the first material to act as a heat sink.

11. The composite window of claim 10, wherein said first group of high melting point materials include lithium, boron, beryllium, carbon (diamond), silicon, magnesium, aluminum and alloys thereof.

12. The composite window structure of claim 10, wherein the high tensile strength materials are selected from thermoset polymers.

13. The composite window structure of claim 10, wherein the first group of materials include materials with high heat conductivity.

14. The composite window structure of claim 10, wherein said alternating layers comprise layers of material selected from said first group laminated to opposing faces of the layer of said second group of material.

15. The composite window structure of claim 10, wherein the high tensile strength materials are selected from the group including: KEVLAR, KAPTON, MYLAR, TEFLON, and FORMVAR.

16. A composite window structure for transmitting x-ray radiation and for shielding radiation generated debris, comprising:

a layer of a first x-ray transmissive polymeric material; and heat sink means with the first layer for maintaining the structure strength of the first polymeric material.

17. The composite window structure of claim 16, wherein the first x-ray transmissive polymeric material is a least ~2.5 μm in thickness.

18. The composite window structure of claim 16, wherein said heat sink means comprises a second material having a thermal conductivity > than the first polymeric material.

19. The composite window structure of claim 17, wherein the second material is at least ~12 μm in thickness.

20. The composite window structure of claim 18, further comprising a plurality of alternating first and second x-ray transmissive materials.

* * * * *